United States Patent [19]

Harrington

[11] Patent Number: 4,653,414

[45] Date of Patent: Mar. 31, 1987

[54] APPARATUS FOR FEEDING FABRIC PARTS TO SEW A FELLED SEAM

[75] Inventor: Richard L. Harrington, Farmersville, Tex.

[73] Assignee: Levi Strauss & Co., San Francisco, Calif.

[21] Appl. No.: 728,762

[22] Filed: Apr. 30, 1985

[51] Int. Cl.[4] ..... D05B 35/04

[52] U.S. Cl. ..... 112/142; 112/322; 112/306

[58] Field of Search ..... 112/142, 147, 150, 322, 112/149, 153, 121.26, 153, 306

[56] References Cited

U.S. PATENT DOCUMENTS

| | | | |
|---|---|---|---|
| 331,108 | 11/1885 | Arnold | 112/322 |
| 1,212,539 | 1/1917 | Molyneux et al. | 112/142 |
| 1,844,411 | 2/1932 | Shutzer | 112/147 |
| 3,417,718 | 12/1968 | Andersson | 112/153 |
| 3,903,820 | 9/1975 | Kleinschmidt et al. | 112/153 |
| 4,395,963 | 8/1983 | Diacont, Jr. et al. | 112/142 X |

FOREIGN PATENT DOCUMENTS

| | | | |
|---|---|---|---|
| 2090298 | 7/1982 | United Kingdom | 112/147 |

*Primary Examiner*—Werner H. Schroeder
*Assistant Examiner*—Andrew M. Falik
*Attorney, Agent, or Firm*—Hubbard, Thurman, Turner & Tucker

[57] ABSTRACT

Fabric parts are fed to a sewing operation through a lap seam folder and the overlapped edges of the parts are maintained in proper relationship by a pair of rollers engageable with the respective parts and mounted for rotation in respective planes of rotation which intersect the feedline of the parts approaching the sewing needle. The rollers are mounted on pivotally supported arms which are operably connected to respective pneumatic cylinder type actuators for moving the arms between operative and retracted positions and for adjusting the biasing force on the arms in accordance with the type of fabric being fed through the seam folder device. The biasing forces on the rollers may be adjusted by adjusting the plane of rotation with respect to the feed direction as well as by the biasing force provided by the respective actuators.

34 Claims, 8 Drawing Figures

APPARATUS FOR FEEDING FABRIC PARTS TO SEW A FELLED SEAM

BACKGROUND OF THE INVENTION

1. Field of the Invention

The present invention pertains to an apparatus comprising retractable rollers which are biased into engagement with two opposed fabric parts for biasing the fabric parts toward each other while they are being fed through a lap or felled seam folder to produce a more uniform seam in a sewing operation.

2. Background

In many sewing operations the joining of two fabric parts is advantageously accomplished by sewing a so-called felled or lap type seam wherein the edges of the two parts are overlapped and the respective parts are then folded back on the edge of the other part. This type of seam is widely used in the manufacture of garments such as shirts and trousers.

Although various folding devices have been developed to assist in forming the seam as the cooperating parts are fed through a sewing machine, it is difficult to maintain the proper engagement of the parts as they are being fed to and through the sewing operation. Since it is desirable to minimize the width of the seam, the amount of overlap of the edge of one part with the edge of another part is desirably minimized which aggravates the problem of maintaining a proper amount of overlap while feeding the material into a sewing apparatus.

The object of this invention is to minimize the condition of improper overlap of edges of cooperating fabric parts in sewing a felled or lap type seam in order to maintain a more uniform seam and to increase the rate of production of garments and other articles which are joined together with a felled or lap type seam.

SUMMARY OF THE INVENTION

The present invention comprises an apparatus for providing a more uniform felled or lap type seam between cooperating fabric parts which are sewn together at such a seam and wherein the rate of feeding in the sewing operation and the uniformity of the seam construction is enhanced.

In accordance with one aspect of the present invention, there is provided an apparatus for use in conjuction with a conventional sewing machine which also operates in conjunction with a lap seam folder to bias opposed fabric parts toward each other as the parts pass through the folder to produce a uniform felled or lap type seam. In accordance with another aspect of the present invention the biasing apparatus comprises a pair of opposed rollers which are adapted to be engaged with the respective fabric parts which are being fed through a lap seam folder for biasing the parts to extend fully into the folder so that the edges of the parts overlap uniformly.

In accordance with still another aspect of the present invention there is provided a biasing mechanism for opposed fabric parts being fed to a sewing operation through a lap seam folder characterized by a pair of rollers which are operably connected to actuator means to bias the roller into engagement with the fabric parts, respectively, and wherein the rollers are canted at an acute angle with respect to the direction of feeding the parts toward a sewing needle so that the parts are urged fully into the folder mechanism and maintained properly engaged with each other.

In accordance with yet another aspect of the present invention there is provided an apparatus for attachment to a sewing machine characterized by a pair of spaced apart pneumatically controlled piston and cylinder type actuators which are respectively connected to movable arms which are operable to raise and lower a pair of canted biasing rollers for engagement with cooperating fabric parts being fed through a lap seam folder and toward a sewing needle of a sewing machine. The cylinder actuators are advantageously supported on the side of the sewing machine opposite the side from which the parts are fed to minimize obstructions and the ability to view the fabric parts as they are fed toward the sewing operation.

In accordance with yet a further aspect of the present invention an apparatus is provided for biasing cooperating fabric parts into and through a lap seam folder wherein the angle formed between the plane of rotation of the respective rollers and the direction of feeding of the fabric parts may be adjusted to increase or decrease the biasing effort. Still further, in accordance with the present invention the roller actuators may be controlled to adjust the downwardly exerted biasing force on the fabric parts to adjust the biasing effort and to compensate for different types and weights of fabric.

The abovenoted features and advantages of the invention as well as other superior aspects thereof will be further appreciated by those skilled in the art upon reading the detailed description which follows in conjunction with the drawing.

DESCRIPTION OF THE PREFERRED EMBODIMENT

Figure 1:
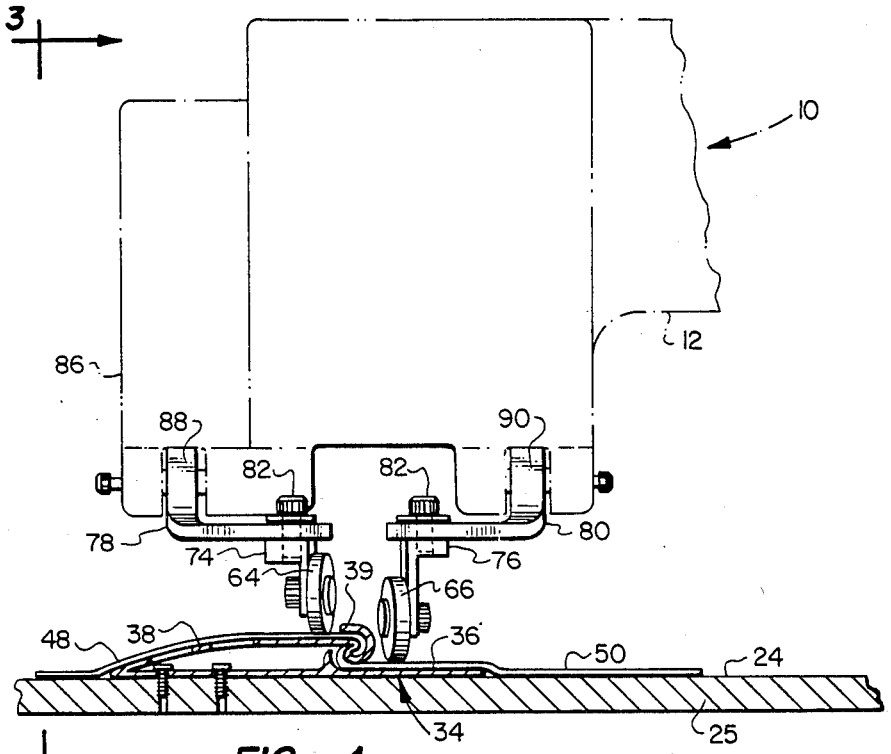
FIG. 1 is a partial front elevation of a conventional sewing machine looking in the direction of feed of fabric to the machine and including the feeding apparatus of the present invention.

In the description which follows like parts are marked throughout the specification and drawing with the same reference numerals, respectively. The drawing figures are not necessarily to scale and in certain views parts may be drawn rotated into the plane of the drawing for clarity.

Figure 2:
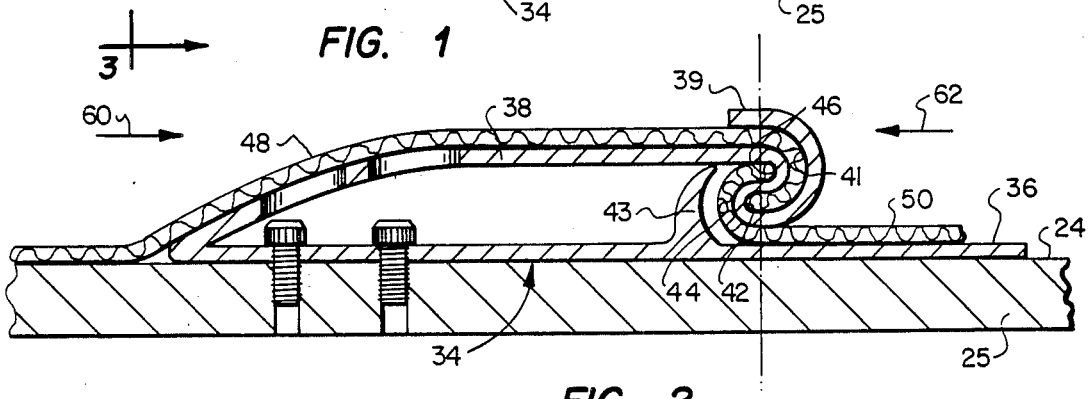
FIG. 2 is a detail view of the lap seam folder taken from line 2—2 of FIG. 3.
Figure 3:
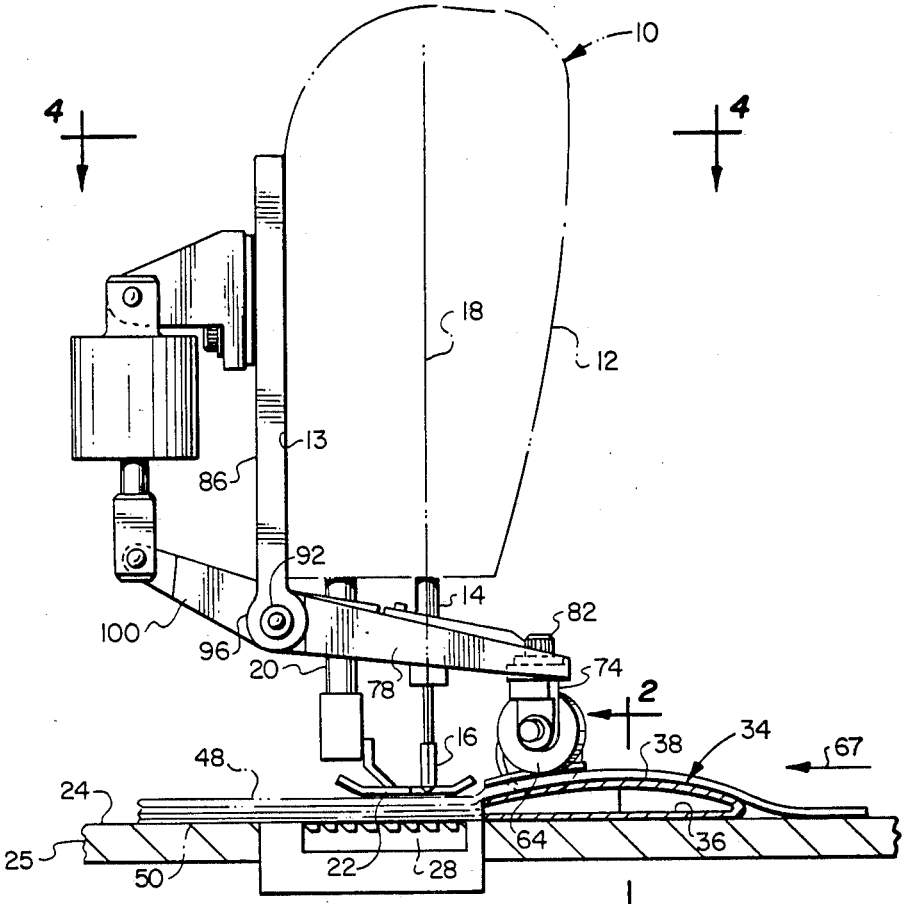
FIG. 3 is a side view of the apparatus taken generally from the line 3—3 of FIG. 1.
Figure 4:
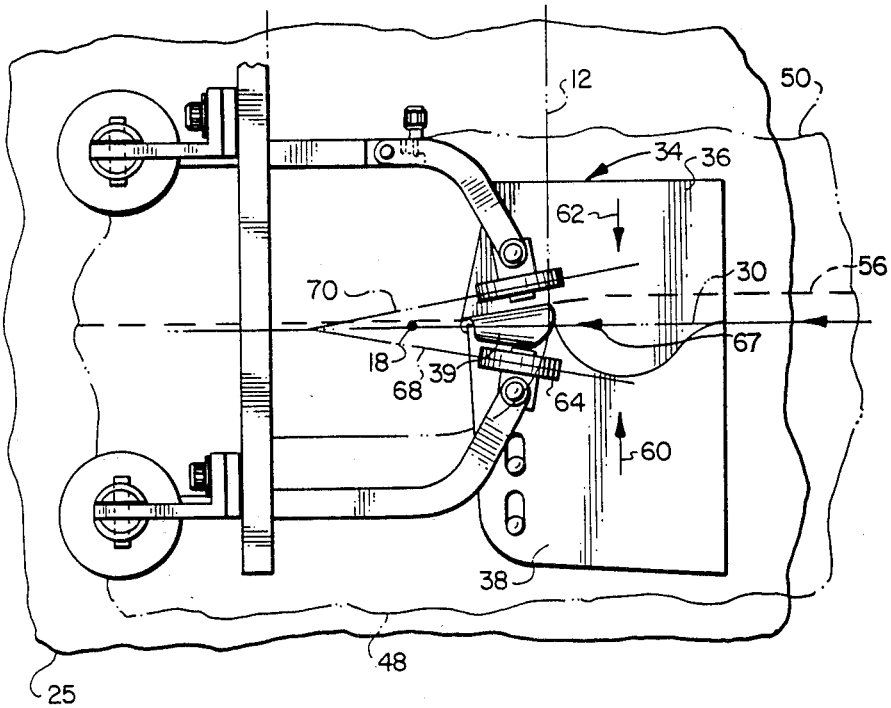
FIG. 4 is a plan view taken generally from the line 4—4 of FIG. 3.

Referring to FIGS. 1 through 3, in particular, the present invention is adapted to be used in conjunction with a conventional motor driven sewing machine generally designated by the numeral 10. The sewing machine 10 has a housing 12 for supporting a reciprocating needle arm 14, FIG. 3, on which a conventional sewing needle 16 is mounted for reciprocation along an axis 18. A retractable shaft 20 is also supported by the housing 12 and is connected at its distal end to a conventional presser foot 22. The presser foot 22 is movable downwardly to hold the fabric parts being sewn in engagement with a surface 24 formed by a suitable support plate 25 or the like. A conventional feeding means for example a feed dog system including a feed dog 28 is mounted for engagement with the fabric to advance the fabric in timed relationship with the operation of the needle 16. As shown in FIG. 4, numeral 30 designates the centerline of a path which includes a vertical plane through the axis 18 of the needle 16 and the direction of feed of material towards the needle 16 as indicated by the arrows. Those skilled in the art will recognize that a double needle configuration may also be used in conjunction with sewing felled or lap seams in accordance with the present invention. However, for simplicity only one needle 16 and an associated presser foot 22 are illustrated in the interest of clarity and conciseness.

Referring further to FIGS. 1 through 4, the apparatus of the present invention is advantageously adapted to be used in conjunction with a lap seam folder device, generally designated by the numeral 34. The seam folder 34 includes a generally thin plate-like base portion 36 which is suitably secured to the plate 25 forming the surface 24 and an upwardly and forwardly projecting support plate 38 which extends in the direction of feeding cooperating fabric parts along the axis 30. Viewing FIG. 2, the right distal edge 39 of the plate 38 is formed so as to fold back on itself in opposite directions to form a generally U-shaped arcuate channel 41 having a dead end 42. A curved wall 43 projects upwardly from the base plate 36 and together with the folded end 39 of the support plate 38 forms a second somewhat U-shaped channel 44 opposite the channel 41 and having a dead end 46 overlying the dead end 42 of the channel 41. The channels 41 and 44 are open at their opposite longitudinal ends to permit feeding cooperating fabric parts 48 and 50 along the axis 30 to form a lapped or felled seam.

Figure 5:
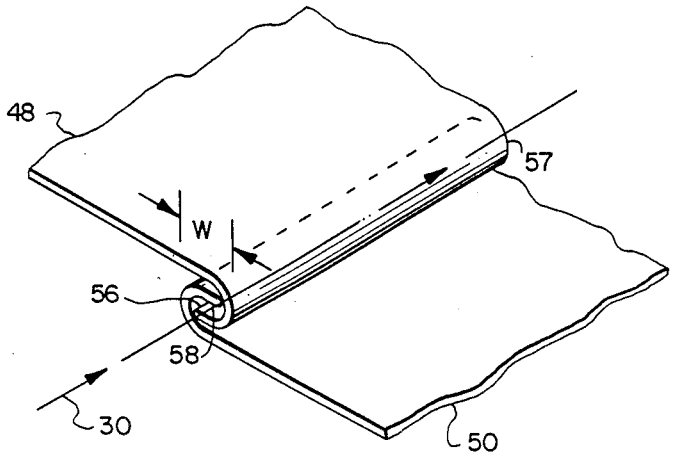
FIG. 5 is a detail view showing portions of two fabric parts overlapped in the configuration provided by the seam folder.

Referring briefly to FIG. 5, the configuration of the seam formed by the folder device 34 is illustrated wherein the parts 48 and 50 have lateral edges 56 and 58, respectively, which overlap each other to form plural layers of fabric having a marginal edge 57 of predetermined width W as the parts are guided through the folder device 34 and are biased so that the respective edges of the fabric parts engage the bottom or dead end portions 42 and 46 of the respective channels.

In order to control the overlap of the parts 48 and 50, which is determined by full engagement of the edges of the parts into the folder channels 41 and 44, the parts 48 and 50 should be biased laterally toward each other in the directions of the arrows 60 and 62, FIG. 2. This operation can be performed by hand but with a lack of reliability and uniformity of forming the desired width or degree of overlap of the respective edges of the fabric parts. For example, an operator may adjust a manual biasing force in accordance with feeding a particular weight and type of fabric through the folder 34 after repeated operations using parts made of that particular fabric; however, when fabric thickness, weave, material, and weight has changed the biasing forces must be changed accordingly and manual adjustments to insure proper seam overlap are not reliable.

In accordance with the present invention apparatus is provided for biasing the lateral edges 56 and 58 of the respective fabric parts fully into the channels 41 and 44, respectively, to control uniformity of the lapped or felled seam sewn by the machine 12. As illustrated in FIGS. 1, 3 and 4, a pair of opposed biasing rollers 64 and 66 are disposed above the surfaces of the folder device 34 and above the respective fabric parts 48 and 50 and are engageable with the parts to tend to move the parts laterally as they are fed in a direction along the axis 30 corresponding to the directional arrow 67 in FIGS. 3 and 4. The rollers 64 and 66 are adjusted for rotation in respective planes 68 and 70, FIG. 4, which intersect the axis 30 and each other in the direction of the arrow 67. The angles formed between the planes 68 and 70 and the vertical plane represented by the axis 30 may be adjusted in accordance with the requirements for biasing effort of particular types of material. Moreover, the angles formed by the planes 68 and 70 with the vertical plane through the axis 30 may be adjusted independent of each other since dissimilar pieces of fabric may be advanced through the folder device 34 to be sewn together.

Figure 6:
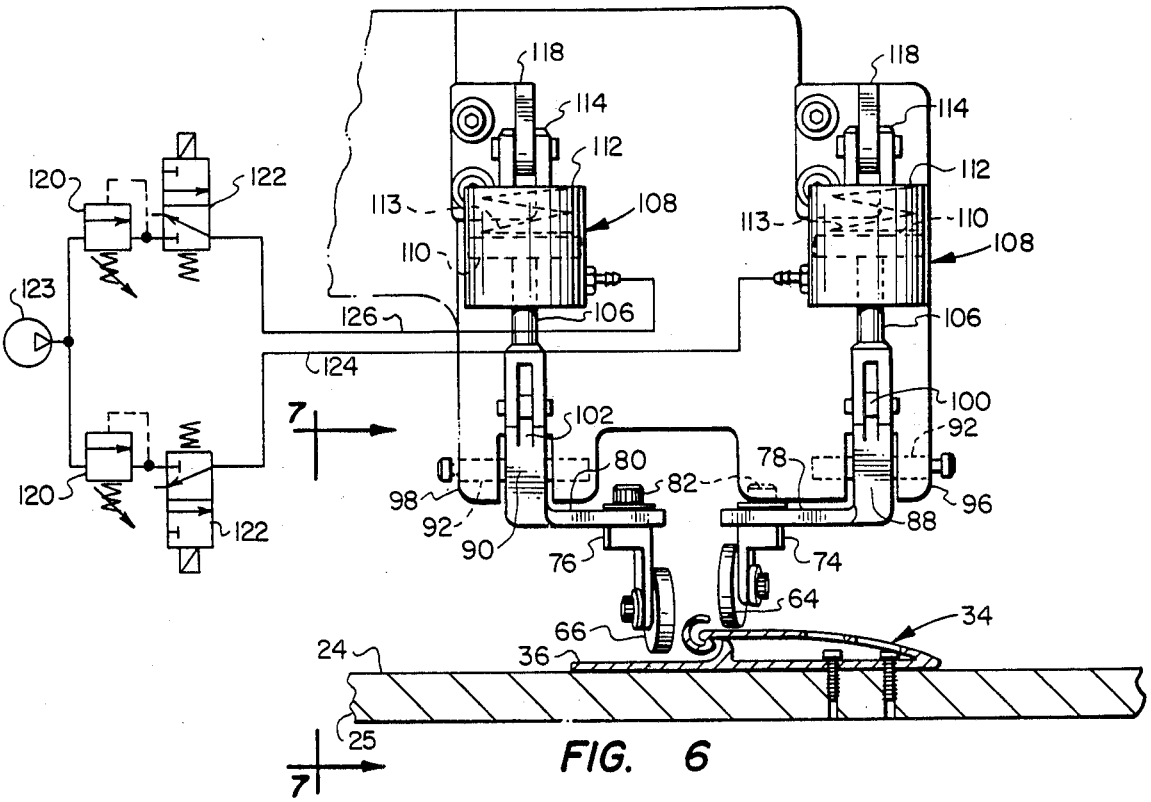
FIG. 6 is a view taken from the opposite direction of the view of FIG. 1.

Referring to FIGS. 1 and 6, the rollers 64 and 66 are rotatably supported on respective support brackets 74 and 76, which are each, respectively, connected to elongated support arms 78 and 80. The brackets 74 and 76 are secured to the respective support arms by threaded fasteners 82 and the angle of the plane of rotation with respect to the axis 30 may be adjusted by loosening the fasteners 82 and rotating the respective support brackets to adjust the planes of rotation of the respective rollers. As illustrated in FIGS. 1 and 6, the bracket 74 is shorter than the bracket 76 so that the roller 64 is disposed in proper relationship to the upper surface of the plate 38 in a relaxed as well as engaged position of the roller with the fabric part 48.

As shown in FIGS. 1, 3 and 6, the support arms 78 and 80 are each pivotally supported on a mounting plate 86 which in turn is adapted to be supported on the sewing machine housing 12 on the side 13 thereof, FIG. 3, opposite the side from which the fabric parts are fed toward the needle 16. The support arms 78 and 80 each include hub portions 88 and 90, respectively which are provided with suitable bores for receiving arm supporting pivot pins 92. The pins 92 are each journalled by suitable bearing means, not shown, housed in spaced apart bosses 96 and 98 formed on the mounting plate 86. The support arms 78 and 80 each include respective upwardly projecting arm portions 100 and 102, FIGS. 3, 6 and 7, on the side of the pivot axes formed by the pins 92 opposite the side to which the respective rollers 64 and 66 are connected, and which arm portions are respectively connected to piston rods 106, FIG. 6, of spaced apart pneumatic piston and cylinder type actuators 108.

The actuators 108 each include piston members 110 slidably disposed in an actuator cylinder 112. The cylinders 112 are each formed with clevis portions 114 on their distal ends opposite the piston rods 106 for connection to respective support brackets 118 secured on the mounting plate 86. The actuators 108 may be of the single acting spring return type wherein in response to supplying pressure fluid to the underside or rod side of the respective pistons 110 the piston rods 106 are retracted into the cylinders 112 to effect a downward biasing force on the respective rollers 64 and 66. This downward biasing force, viewing FIGS. 1, 3 and 6, for example, urges the rollers 64 and 66 to press the respective fabric parts 48 and 50 into engagement with the respective support surfaces of the folder 34 and in accordance with the pressure of the fluid urging the pistons 110 upwardly, viewing FIG. 6, the biasing force may be easily controlled. The cylinders 112 are adapted to support therein suitable piston return springs 113 for urging the pistons 110 downwardly, viewing FIG. 6, against the pressure of fluid within the cylinders acting on the underside of the respective pistons.

The operation of the respective cylinders 108 may be controlled by suitable control means including a source of pressure air 123, which pressure air may be delivered to the respective cylinders 110 through adjustable pressure regulator valves 120, FIG. 6, and solenoid operated valves 122 interposed in respective fluid supply conduits 124 and 126. The valves 122 are operable in their deenergized positions to vent pressure fluid from the respective conduits 124 and 126 and the cylinder actuators 108 whereby the springs 113 effect movement of the respective support arms 78 and 80 to raise the rollers 64 and 66 away from the folder device 34. The rollers 64 and 66 are, accordingly, adapted for independent control between operative and inoperative positions and in accordance with the independent adjustment of the respective pressure regulators 120, the biasing force exerted on a fabric part under the respective rollers may be selectively controlled. Although the pressure regulators 120 are illustrated as manually adjustable types, those skilled in the art will appreciate that the regulators may be automatically controlled in conjunction with a system which predetermines the type of fabric part approaching the sewing operation whereby the biasing force exerted by the respective rollers may be automatically controlled in accordance with the particular fabric part engaged by the rollers 64 and 66, respectively.

Figure 7:
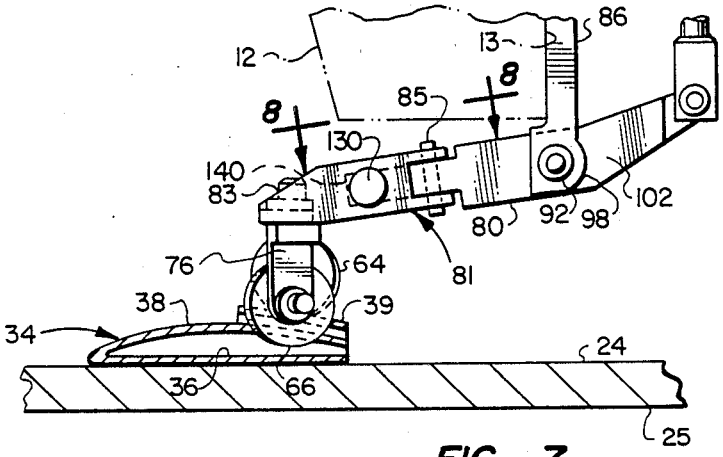
FIG. 7 is a detail view taken generally from the line 7—7 of FIG. 6.
Figure 8:
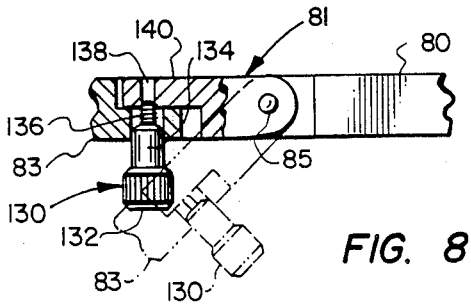
FIG. 8 is a detail view taken from the line 8—8 of FIG. 7.

As illustrated in FIGS. 7 and 8, at least the arm 80 may be adapted to have an articulated portion 81 disposed between the pivot axis formed by the pin 92 and the roller 66 and characterized by an arm part 83 which is hinged to the remaining portion of the arm 80 by a hinge pin 85 for movement about a generally vertical axis to swing the roller 66 away from the vicinity of the needle 16 and the presser foot 22 whereby access to these components may be obtained as needed during sewing operations. The arm part 83 is secured to the main body of the arm 80 by a releasable fastener 130 having a knurled head 132, a supporting body 134 and a threaded shank 136 extending through a suitable bore in the arm part 83 and engageable with a cooperating threaded bore 138 formed on a projecting tongue part 140 of the arm 80. Those skilled in the art will recognize that the arm 78 may also be formed to have a swingaway lockable arm part similar to that for the arm 80, if desired.

The operation of the apparatus described herein is believed to be readily apparent from the foregoing description; however, briefly, upon initiating operation of the apparatus, the fabric part 48 and 50 may be manually or mechanically moved into position wherein the edges 56 and 58 are fully interposed in the respective channels 41 and 44 and generally contiguous with the dead ends 42 and 46 of the channels in order to control the amount of seam overlap. The fabric parts 48 and 50 may then be fed in the direction of the arrow 67 until they suitably engage the presser foot 22 and the feed dogs 28 whereupon the rollers 64 and 66 may be lowered into an operative position by energizing the respective control valves 122. In accordance with the type of fabric being sewn by the machine 10 the planes of rotation 68 and 70 of the respective rollers 64 and 66 have been preadjusted and the biasing forces, as controlled by the pressure regulators 120, have also been manually or automatically adjusted.

Upon initiating operation of the sewing machine 10 the overlapped fabric parts 48 and 50 are automatically advanced by the feed system of the machine 10 and as the parts are drawn through the machine the forces exerted on the respective parts by the biasing rollers 64 and 66 urge the parts fully into the respective channels 41 and 44 of the folder 34. Accordingly, the fabric parts 48 and 50 may be advanced through the machine as fast as the sewing operation will permit and the amount of overlap between the parts is automatically controlled and maintained uniform by the biasing rollers 64 and 66. If it is desired to adjust the planes of rotation of either one of the rollers 64 and 66, the fasteners 82 may be loosened to permit rotation of the brackets 74 and 76. Independent control of the biasing effort on the respective fabric parts 48 and 50 assures that the biasing effort may be adjusted in accordance with the type of fabric, its thickness, or stiffness as well as other properties which may influence the effort required to force the fabric completely into the folder recesses or channels 41 and 44.

Thanks to the provision of the articulated arm part 81 at least the roller 66 may be swung out of position to provide access to the presser foot 22 and sewing needle 16. Thanks also to the arrangement of the respective support arms 78 and 80, the actuators 108 and the mounting plate 86, the support structure for the roller 64 and 66 is placed out of the way of the machine operator in the normal operation of placing fabric parts in position to be sewn and being able to view the sewing operations. Alternatively, however, the roller 64 and 66 may be mounted on suitable brackets connected directly to the piston rods of a pair of pressure fluid cylinder type actuators, not shown, and mounted directly above the respective rollers on the side of the machine housing 12 opposite the side 13 to which the mounting plate 86 is attached. In conjunction with the use of automatic feeding mechanisms the particular location of the actuator cylinders may not be as important as for use with machines which are manually fed.

Although a preferred embodiment of the invention has been described herein in detail, those skilled in the art will recognize that various substitutions and modifications may be made to the embodiment described without departing from the scope and spirit of the invention recited in the appended claims.

What is claimed is:

1. In combination with a sewing machine including reciprocating needle means, a fabric support surface, and means for feeding separate fabric portions along said surface and past said needle means, means for forming said separate fabric portions to provide a felled or overlapped seam including:

(a) a folder device for continuously folding said separate fabric portions into plural layers having a marginal edge of predetermined width to form said seam as said separate fabric portions are advanced along a predetermined path by said feed means, and;

(b) means located relatively upstream from said feeding means and operable concomitantly with said feeding means for urging portions of said separate fabric portions in opposite directions, respectively, and transversely relative to said path to maintain said marginal edge of a predetermined width during feeding of said separate fabric portions to form said seam.

2. The combination set forth in claim 1 wherein:

said means for urging said portions of said fabric in opposite directions comprise respective members engageable with said portions of said fabric at locations on said portions of said fabric on opposite sides of said path as said fabric is moved along said path to cause said portions of said fabric to move toward each other, simultaneously.

3. The combination set forth in claim 2 wherein:

said members engageable with said portions of said fabric comprise respective roller members.

4. The combination set forth in claim 3 including:

means for supporting said roller members, respectively, for rotation in a plane of rotation forming a predetermined angle of intersection with said path.

5. The combination set froth in claim 4 wherein:

said means for supporting said roller members includes actuator means for biasing said roller members into engagement with said portions of said fabric, respectively, with predetermined biasing forces.

6. The combination set forth in claim 5 wherein:

said actuator means comprises respective pneumatic cylinder and piston actuators operably connected to each of said roller members and to a source of pressure air, and air pressure regulator means for selectively controlling the biasing force of each roller member acting on said portions of said fabric, respectively.

7. The combination set forth in claim 6 including:

valve means for selectively controlling said actuators to move said roller members between operative and inoperative positions.

8. The combination set forth in claim 5 wherein:

said roller members are supported on respective lever arms which are pivotally connected to a support plate, said sewing machine includes a housing extending above said fabric support surface and having opposed sides extending generally normal to said path, and said support plate is mounted on one side of said housing opposite another side in the direction of feeding said fabric and whereby said lever arms extend from said housing from said one side of said housing so as to provide a substantially obstructed area over said folder.

9. The combination set forth in claim 8 wherein:

at least one of said arms includes a distal end part supporting one of said rollers and connected to the remaining part of said arm by hinge means for moving said one roller between a working position disposed directly above said folder and a nonworking position.

10. A sewing apparatus combination, comprising:

(a) a fabric support surface, feed means for advancing fabric along said support surface in a predetermined path;

(b) means for forming at least two fabric parts to provide a felled or overlapped seam including a folder device for continuously folding said fabric parts into plural layers having a marginal edge to form said seam as said fabric parts are advanced by said feed means along said predetermined path, and;

(c) means located relatively upstream from said feeding means and operable concomitantly with said feed means for urging said fabric parts to move toward each other and generally transversely relative to said path and comprising:

(1) respective roller members engageable with aid fabric parts, respectively, at locations on said fabric parts on opposite sides of said path as said fabric parts are moved along said path to cause said fabric parts to move toward each other, simultaneously;

(2) means for supporting said roller members for rotation in preselected planes of rotation forming predetermined angles of intersection with said path, and;

(3) actuator means for biasing said roller members into engagement with said fabric parts, respectively, with predetermined biasing forces so as to maintain said fabric parts overlapped to form said seam.

11. The apparatus set forth in claim 10 wherein:

said actuator means include respective pneumatic cylinder and piston actuators operably connected to each of said roller members and to a source of pressure air, and air pressure regulator means for selectively controlling the biasing force of each roller member acting on said fabric parts, respectively.

12. A device for maintaining edge portions of fabric in a positioned relationship in a sewing machine which includes feed means for feeding separate fabric portions along a support surface and past a reciprocating needle, said device comprising:

means for forming an overlapped seam of the edge portions of fabric as the fabric portions are advanced along a predetermined path through the sewing machine and past the needle, and means located relatively upstream from said feeding means and operative concomitantly with said feed means for urging portions of said fabric in opposing directions transverse to the path to maintain the positioned relationship of said edge portions in the forming means.

13. A device according to claim 12 wherein said urging means further includes means for engaging said portions of fabric at locations upon the fabric on opposite sides of the path for simultaneously urging the portions in the opposite direction as the fabric is moved along the path in the sewing machine.

14. A device according to claim 13 wherein said urging means includes a roller means for engaging portions of the fabric and having a plane of rotation forming a predetermined angle of intersection with the path, said roller means including supporting means having an actuator means for biasing at least one roller member into engagement with the portions of the fabric respectively with predetermined bias forces, the actuator means including at least one pneumatic cylinder and piston actuators operably connected to each of the roller members and to a source of pressure air, and air pressure regulator means for selectively controlling the biasing force of each roller member acting on the portions of the fabric respectively.

15. A device according to claim 14 further including valve means for selectively controlling the actuators to move the roller members between operative and inoperative positions.

16. A device according to claim 15 wherein the roller members are supported on distal ends of respective lever arms which are pivotally connected to a support plate mounted upon the sewing machine.

17. A device according to claim 16 wherein the support plate is mounted generally in the direction of the feeding of fabric.

18. A device according to claim 17 wherein the lever arms are positioned to extend over the folder.

19. A device according to claim 18 wherein at least one of the arms includes a hinge means for moving the roller members between a working position disposed directly above the folder means and a nonworking position.

20. A device according to claim 19 wherein the pneumatic cylinder and piston further include a spring means positioned to provide a force upon said piston opposite a force provided by the air pressure.

21. In combination with a sewing machine including reciprocating needle means, a fabric support surface, and means for feeding fabric along said surface and past said needle means, means for forming said fabric to provide a felled or overlapped seam including a folder device for continuously folding said fabric into plural layers having a marginal edge of predetermined width to form said seam as said fabric is advanced along a predetermined path by said feed means, and;

means located relatively upstream from said feeding means and operative concomitantly with said fabric feeding means for urging portions of said fabric in opposite directions, respectively, and transversely relative to said path to maintain said marginal edge of a predetermined width during feeding of said fabric to form said seam, said urging means including respective roller members engageable with said portions of said fabric at locations on said portions of said fabric on opposite sides of said path as said fabric is moved along said path to cause said portions of said fabric to move toward each other, simultaneously.

22. The combination set forth in claim 21 including:

means for supporting said roller members, respectively, for rotation in a plane of rotation forming a predetermined angle of intersection with said path.

23. The combination set forth in claim 22 wherein:

said means for supporting said roller members includes actuator means for biasing said roller members into engagement with said portions of said fabric, respectively, with predetermined biasing forces.

24. The combination set forth in claim 23 wherein:

said actuator means comprises respective pneumatic cylinder and piston actuators operably connected to each of said roller members and to a source of pressure air, and air pressure regulator means for selectively controlling the biasing force of each roller member acting on said portions of said fabric, respectively.

25. The combination set forth in claim 24 including:

valve means for selectively controlling said actuators to move said roller members between operative and inoperative positions.

26. The combination set forth in claim 23 wherein:

said roller members are supported on respective lever arms which are pivotally connected to a support plate, said sewing machine includes a housing extending above said fabric support surface and having opposed sides extending generally normal to said path, and said support plate is mounted on one side of said housing opposite another side in the direction of feeding said fabric and whereby said lever arms extend from said housing from said one side of said housing so as to provide a substantially obstructed area over said folder.

27. The combination set forth in claim 26 wherein:

at least one of said arms includes a distal end part supporting one of said rollers and connected to the remaining part of said arm by hinge means for moving said one roller between a working position disposed directly above said folder and a nonworking position.

28. A device for maintaining edge portions of fabric in a positioned relationship in a sewing machine which includes fabric feed means for feeding the fabric portions along a support surface and past a reciprocating needle, said device comprising:

means for forming an overlapped seam of the edge portions of fabric as the fabric portions are advanced by said feed means along a predetermined path through the sewing machine and past the needle, and means located relatively upstream from said feeding means and operative concomitantly with said fabric feed means for urging portions of said fabric in opposing directions transverse to the path to maintain the positioned relationship of said edge portions in the forming means, said urging means further including means for engaging said portions of fabric at locations upon the fabric on opposite sides of the path for simultaneously urging the portions in the opposite direction as the fabric is moved along the path in the sewing machine, said engaging means including a roller means for engaging portions of the fabric and having a plane of rotation forming a predetermined angle of intersection with the path, said roller means including supporting means having an actuator means for biasing at least one roller member into engagement with the portions of the fabric respectively with predetermined bias forces, the actuator means including at least one pneumatic cylinder and piston actuators operably connected to each of the roller members and to a source of pressure air, and air pressure regulator means for selectively controlling the biasing force of each roller member acting on the portions of the fabric respectively.

29. A device according to claim 28 further including valve means for selectively controlling the actuators to move the roller members between operative and inoperative positions.

30. A device according to claim 29 wherein the roller members are supported on distal ends of respective lever arms which are pivotally connected to a support plate mounted upon the sewing machine.

31. A device according to claim 30 wherein the support plate is mounted generally in the direction of the feeding of fabric.

32. A device according to claim 31 wherein the lever arms are positioned to extend over the folder.

33. A device according to claim 32 wherein at least one of the arms includes a hinge means for moving the roller members between a working position disposed directly above the folder means and a nonworking position.

34. A device according to claim 33 wherein the pneumatic cylinder and piston further include a spring means positioned to provide a force upon said piston opposite a force provided by the air pressure.

* * * * *